US007028866B2

(12) United States Patent
Kunesh et al.

(10) Patent No.: US 7,028,866 B2
(45) Date of Patent: Apr. 18, 2006

(54) PRESSURIZED PLASTIC BOTTLE FOR DISPENSING AN AEROSOL

(75) Inventors: Edward J. Kunesh, Franksville, WI (US); Allen D. Miller, Racine, WI (US); David P. Mather, Milwaukee, WI (US); Michael J. Skalitzky, Kenosha, WI (US); James C. Boda, Merrimac, WI (US); Douglas J. Birkholz, Monona, WI (US)

(73) Assignee: S.C. Johnson & Son, Inc., Racine, WI (US)

( * ) Notice: Subject to any disclaimer, the term of this patent is extended or adjusted under 35 U.S.C. 154(b) by 119 days.

(21) Appl. No.: 10/355,628

(22) Filed: Jan. 31, 2003

(65) Prior Publication Data

US 2004/0149781 A1 Aug. 5, 2004

(51) Int. Cl.
*B65D 83/00* (2006.01)

(52) U.S. Cl. ..... 222/402.1; 215/382; 220/604

(58) Field of Classification Search ..... 222/402.1–402.25; 215/382, 371–373; 220/602, 220/604–606, 662, 669, 673, 675, 914, 915; D9/689–693, 520–521, 535
See application file for complete search history.

(56) References Cited

U.S. PATENT DOCUMENTS

| | | | | |
|---|---|---|---|---|
| 2,541,065 | A | 2/1951 | Jabour | 220/3 |
| 2,686,081 | A | 8/1954 | Cooksley | 299/95 |
| 2,964,794 | A * | 12/1960 | Peilstocker et al. | 428/35.7 |
| 3,043,461 | A | 10/1962 | Glassco | 215/1 |
| 3,278,086 | A | 10/1966 | Clozeau et al. | 222/135 |
| 3,403,804 | A | 10/1968 | Colombo | 215/31 |
| D217,585 | S | 5/1970 | Lambelet | D9/1 |
| 3,598,270 | A | 8/1971 | Adomaitis | 215/1 C |
| D225,972 | S | 1/1973 | Khetani | D9/37 |
| 3,759,410 | A | 9/1973 | Uhlig | 215/1 C |
| 3,934,743 | A * | 1/1976 | McChesney et al. | 215/373 |
| 3,984,498 | A | 10/1976 | McChesney et al. | 260/879 |
| 4,792,062 | A * | 12/1988 | Goncalves | 222/135 |
| 5,080,244 | A | 1/1992 | Yoshino | 215/1 C |
| 5,152,411 | A | 10/1992 | Pope et al. | 215/1 C |

(Continued)

FOREIGN PATENT DOCUMENTS

| | | |
|---|---|---|
| DE | 2022534 | 11/1971 |
| EP | 0391817 | 4/1990 |

OTHER PUBLICATIONS

Patent Abstracts of Japan, vol. 2002, No. 05, May 2002 & JP 2002 029581 A (Mandom Corp) Jan. 29, 2002 Abstract; Figure 6.

*Primary Examiner*—Michael Mar
*Assistant Examiner*—Melvin A. Cartagena

(57) ABSTRACT

A pressure resistant plastic bottle for containing and dispensing an aerosol composition. The plastic bottle is comprised of a hollow elongate body having a central portion, a top portion and an opposite bottom portion with the central portion having an inwardly concave configuration extending along its longitudinal direction. The bottom portion of the elongate body is integral with the central portion and defines an outwardly projecting convexly shaped configuration. The top portion of the bottle is integral with the central portion and has an outwardly convex configuration extending along its longitudinal direction and defines a neck having an opening for receiving and dispensing the aerosol composition. A closure covers the opening and is sealingly attached to the neck to contain the aerosol within the plastic bottle.

30 Claims, 2 Drawing Sheets

U.S. PATENT DOCUMENTS

| | | | | |
|---|---|---|---|---|
| 5,224,630 | A * | 7/1993 | Pope et al. | 222/183 |
| 5,261,543 | A | 11/1993 | Ugarelli | 215/1 C |
| 5,383,558 | A | 1/1995 | Wilkinson et al. | 206/508 |
| 5,385,250 | A | 1/1995 | Pasquale | 215/1 C |
| 5,553,753 | A | 9/1996 | Abplanalp | 222/387 |
| D421,910 | S | 3/2000 | Warner et al. | D9/520 |
| 6,095,378 | A | 8/2000 | Potts et al. | 222/402.1 |
| D470,402 | S * | 2/2003 | Kunesh et al. | D9/521 |
| 2003/0000909 | A1 * | 1/2003 | Sakaguchi et al. | 215/44 |
| 2003/0215400 | A1 | 11/2003 | Schroeder et al. | 424/47 |

* cited by examiner

PRESSURIZED PLASTIC BOTTLE FOR DISPENSING AN AEROSOL

BACKGROUND OF THE INVENTION

The present invention relates to dispensers for aerosols or other pressurized products, and more particularly to a pressure resistant plastic bottle for dispensing an aerosol or other comparably pressurized product.

The term "aerosol" will be understood herein to encompass both aerosols, literally, and other liquid or flowable products that can be dispensed from pressurized containers in a manner comparable to aerosolized products. Such products include but are not limited to foamed or gel preparations or to liquid products delivered in a non-aerosol stream.

Pressurized containers for dispensing aerosols are well known in the art, and are typically constructed of metal in order to withstand the inherent internal pressure of aerosols. However, it is desirable to provide a plastic container capable of withstanding the internal pressures generated by an aerosol because plastic has many advantages over metal. Some of these advantages include the ease and economy of manufacture, and aesthetic appeal to an end user.

Despite the desirability of using plastic containers, there are some disadvantages to utilizing plastic materials. For example, it is desirable to avoid plastic containers that have abrupt changes in configuration. The areas of such abrupt changes are stress concentration points which are inherently weak. Another disadvantage is that when the container is subject to internal pressure, certain features of a plastic container may deform. Depending on the wall thickness of the container, the internal volume may change between 3 to 5%. As a result of such stress, slight bulging and/or skewing of the container may occur causing the container to become unsightly, and depending on the location of the deformation the container could become unstable and may not rest properly on a table or other flat surface. It is thus necessary to provide a container design or shape which, when made of a plastic material, can most effectively resist the internal pressures generated by an aerosol without rupturing or becoming unduly distorted. Also, if internal volume changes do occur, then it is desirable that they occur uniformly so that such deformation can be accounted for in the design of the container. Thus, if deformation is known to be uniform, then the container can be designed to accommodate such uniform deformation with the result that the container will be less likely to leak its contents and/or rupture.

SUMMARY OF THE INVENTION

The present invention is directed toward a pressure resistant plastic bottle for containing and dispensing an aerosol composition. The plastic bottle is comprised of a hollow elongate body having a longitudinal axis and an outer wall. The outer wall defines a central portion, a top portion and an opposite bottom portion with the central portion having a circular cross-sectional configuration taken through a plane perpendicular to the longitudinal axis and having an inwardly projecting concave configuration extending along its longitudinal direction. Preferably, the central portion of the bottle has a hyperboloid configuration. The bottom portion of the elongate body is integral with the central portion and defines an outwardly projecting convexly shaped configuration extending along a direction transverse to said longitudinal axis. Preferably, the convexly shaped configuration comprises a base portion having a spherical end configuration and a side portion having a spherical segment configuration. This design of the central portion and bottom portion of the plastic bottle effectively resists the internal pressures generated by an aerosol to minimize any deformation. Further, any deformation that may occur results in a substantially uniform change which can be accommodated by the top portion of the plastic bottle.

The top portion of the bottle is integral with the central portion and has an outwardly projecting convex configuration extending along its longitudinal direction, and defines a neck having an opening for receiving and dispensing the aerosol composition. A closure covers the opening and is sealingly attached to the neck to contain the aerosol within the plastic bottle. The top portion of the bottle includes a flat section between the central portion and the neck. The flat section has a constant circular cross section extending along its longitudinal direction to define a cylindrical configuration, and advantageously functions to provide line contact (rather than point contact) between adjacent bottles as they are moved side-by-side down a conveyor belt in contact with each other. Bottles with touching curved surfaces, i.e. point contact, tend to slide up or down thus changing the spacing between bottles. In contrast, bottles having straight surfaces where they touch, i.e. line contact, tend not to slide vertically and maintain a desired spacing during manufacture and filling.

As the bottom portion of the plastic bottle is convexly shaped and the central portion of the plastic bottle preferably is a hyperboloid, there is a need for providing the plastic bottle with a support surface so that the plastic bottle may stand upright when stored. In order to accomplish this, the plastic bottle includes a cap assembly which includes a cap member having a planar top support surface and a depending skirt which is releasably mounted to the top portion of the plastic bottle with a snap-fit arrangement.

The closure includes a valve member having an axially extended valve stem which must be either depressed or tilted to release the aerosol contained in the plastic bottle. In order to accomplish this, the cap assembly includes an actuator integral with the cap member and operably associated with the stem to activate the valve member and dispense the aerosol composition.

DETAILED DESCRIPTION OF THE INVENTION

Figure 1:
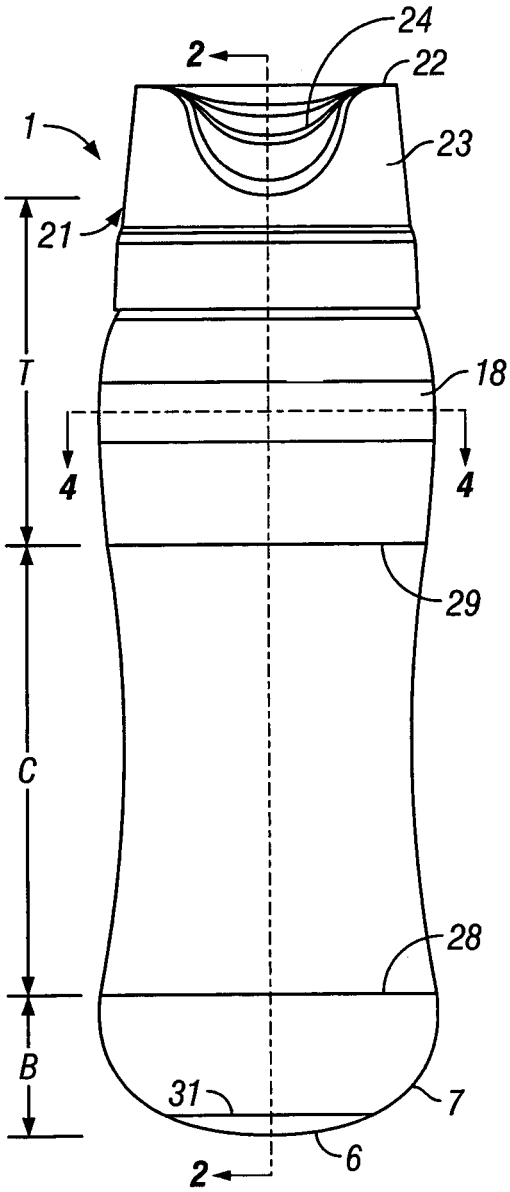
FIG. 1 is an elevational view of a pressure resistant plastic bottle and cap assembly in accordance with the present invention used for containing and dispensing an aerosol composition.

Referring now to the drawings, there is illustrated a pressure resistant plastic bottle generally designated by the numeral 1 for containing and dispensing an aerosol composition. The plastic bottle 1 may be composed of any thermoplastic material that may be formed into the desired shape disclosed herein. Examples of such materials include ethylene based polymers, including ethylene/vinyl acetate, ethylene acrylate, ethylene methacrylate, ethylene methyl acrylate, ethylene methyl methacrylate, ethylene vinyl acetate carbon monoxide, and ethylene N-butyl acrylate carbon monoxide, polybutene-1, high and low density polyethylene, polyethylene blends and chemically modified polyethylene, copolymers of ethylene and C1–C6 mono- or di-unsaturated monomers, polyamides, polybutadiene rubber, polyesters such as polyethylene terephthalate, polyethylene naphthalate, polybutylene terephthalate; thermoplastic polycarbonates, atactic polyalphaolefms, including atactic polypropylene, polyvinylmethylether and others; thermoplastic polyacrylamides, polyacrylonitrile, copolymers of acrylonitrile and other monomers such as butadiene styrene; polymethyl pentene, polyphenylene sulfide, aromatic polyurethanes; styrene-acrylonitrile, acrylonitrile-butadiene-styrene, styrene-butadiene rubbers, acrylontrile-butadiene-styrene elastomers, polyphenylene sulfide, A-B, A-B-A, A-(B-A)$_n$-B, (A-B)$_n$-Y block polymers wherein the A block comprises a polyvinyl aromatic block such as polystyrene, the B block comprises a rubbery midblock which can be polyisoprene, and optionally hydrogenated, such as polybutadiene, Y comprises a multivalent compound, and n is an integer of at least 3, and mixtures of said substances. The preferred thermoplastic material is polyethylene terephthalate (PET). PET is commercially available from numerous sources, and one such source is MNG, Inc. under the trade designation Traytuf®. Preferably, the thermoplastic polymer used to make the plastic bottle 1 is transparent, although opaque and partially opaque polymers would also function adequately.

The plastic bottle 1 may be formed by any conventional molding technique, such as two-stage blow molding. In two-stage blow molding, a pre-form of the plastic is made by injection molding. The pre-form provides the mass of material that eventually is blown into final shape, but it also may include in substantially final form such features as the bottle neck 11 and annular flange 19, described below. The preform is reheated, enclosed within the halves of a blow mold, and thereafter expanded in such mold. Under such a process, the plastic bottle 1 may be formed integrally in a one-piece construction which is the preferred construction. Blow molding techniques, as well as other techniques for manufacturing plastic bottle 1 are well known in the art and need not be further described herein.

Figure 2:
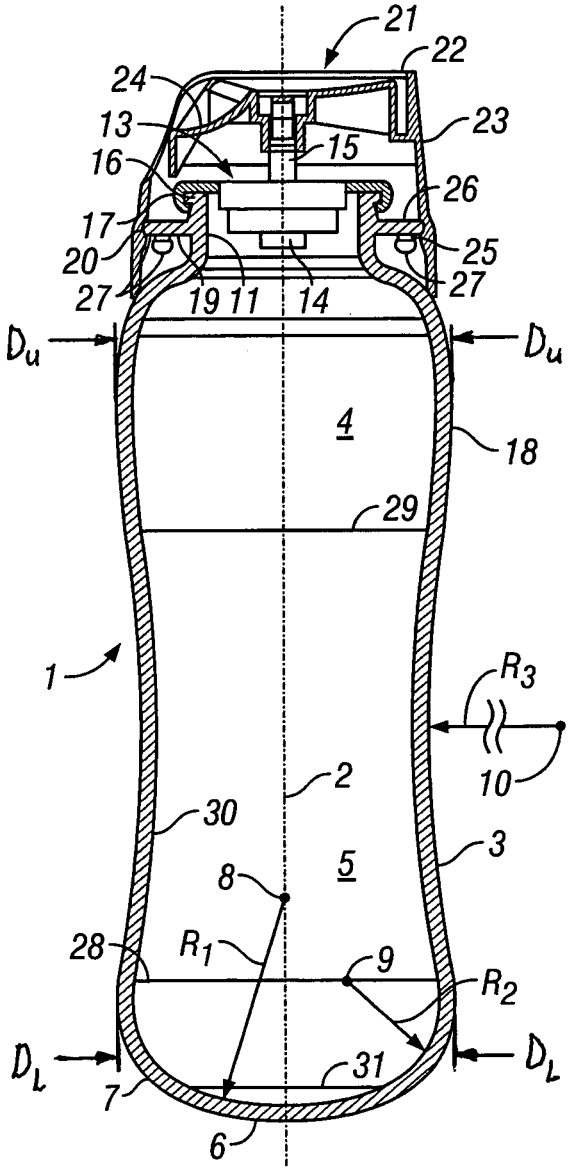
FIG. 2 is a cross-sectional view of the plastic bottle and cap assembly taken along the line 2—2 in FIG. 1 with a closure and valve shown only partially in section.

Referring now to FIGS. 1 and 2, the plastic bottle 1 comprises a hollow elongate body having a longitudinal axis 2 and an outer wall 3. Outer wall 3 may vary in thickness from between about 0.25 mm to about 1.6 mm, but is preferably about 0.64 mm. Bottle 1 may be divided into three sections or portions, namely, central portion C, a top portion T and an opposite bottom portion B. As noted above, each of these portions is integral with the other and is formed as a one-piece construction. The transition between bottom portion B and central portion C is defined by a plane extending perpendicular to axis 2 and is represented by line 28 while the transition between central portion C and top portion T is also defined by a plane extending perpendicular to axis 2 and is represented by line 29. As shown best in FIG. 2, bottom portion B, central portion C and top portion T define an upper compartment 4 and a lower compartment 5 within the body of plastic bottle 1. Compartments 4 and 5 contain the aerosol composition (not shown) which is typically pressurized at an internal pressure of about 275.8 kPa to about 620.5 kPa. Examples of typical aerosol compositions are insecticides, insect repellents, hairsprays, air fresheners, cleaning preparations, and shave preparations including foams and gels. The preferred aerosol is a shave preparation pressurized to about 448.2 kPa, which provides adequate internal pressure for dispensing the aerosol upon actuation of the valve, as will hereinafter be described.

Each of compartments 4, 5 have a maximum diameter, and the maximum diameter of compartment 4 compared to the maximum diameter of compartment 5, or vice versa, ranges between a ratio of from about 2 to 1 to about 1 to 1. A ratio greater than 1 to 1 is preferred in that a ratio greater than 1 to 1 results in a single contact location between bottles 1 when multiple bottles are clustered on a conveyer belt or are otherwise being processed, moved, or packaged as a group. Other preferred features with respect to such a contact location are discussed, below. Preferably, the maximum diameter of $D_u$ upper compartment 4 is slightly greater than the maximum diameter $D_1$ of lower compartment 5 although just the opposite would also be effective. As shown best in FIG. 2, the maximum diameter of upper compartment 4 is located in top portion T above line 29, while the maximum diameter of lower compartment 5 is located in bottom portion B below line 28. The preferred diameter $D_u$ for upper compartment 4 is about 5.334 cm whereas the preferred diameter $D_1$ of compartment 5 is about 5.309 cm. The narrowest diameter, designed by the number 30 and which is located in the middle of central portion C, is approximately 4.57 cm. The overall length of the bottle is about 16.07 cm. It should be noted that although in the preferred embodiment the upper compartment 4 has a diameter and a volume that is slightly greater than the diameter and volume of lower compartment 5, just the opposite could also be acceptable. In other words, the diameter and volume of lower compartment 5 could, in fact, be greater than upper compartment 4 if desired. Preferably, the central portion has a hyperboloid configuration which provides a very ergonomic structure which is easily handled by a user.

Figure 3:
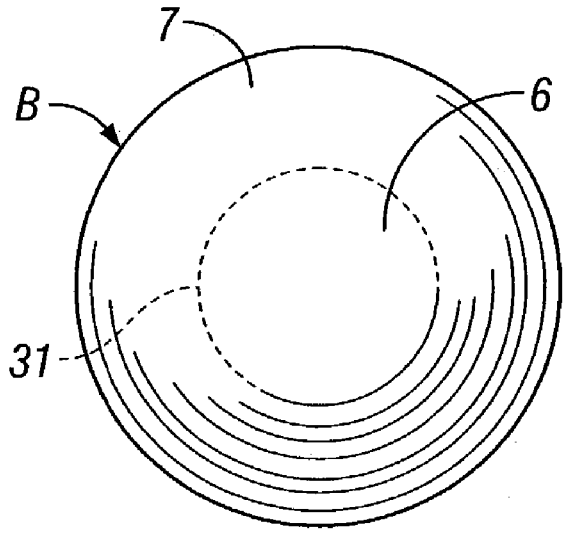
FIG. 3 is a bottom view of the plastic bottle.
Figure 4:
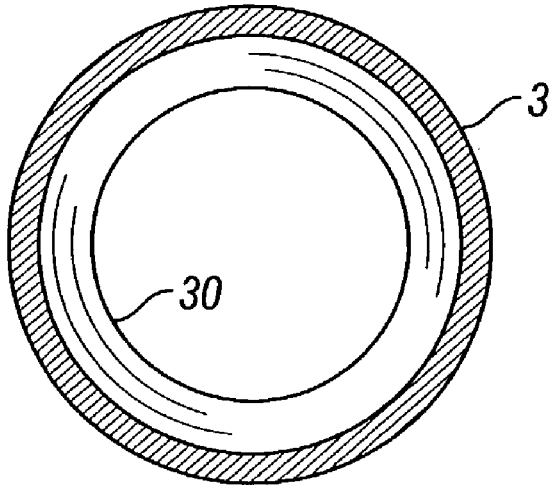
FIG. 4 is a cross-sectional view taken along the line 4—4 in FIG. 1.

The bottom portion B of bottle 1 is integral with the central portion C and defines an outwardly projecting convexly shaped or dome shaped configuration extending along a direction transverse to the axis 2. The term "convexly shaped" or "convexly shaped configuration" refers to any curved or rounded shape projecting outwardly from the transverse plane defined by line 28. Examples of such shapes include a hemisphere, an ellipsoid, a hyperbola, a parabola, an arcuate shaped configuration, or an arcuate shaped configuration having multiple arcuate sections such as a combination of a spherical segment having one radius and a spherical end having a second different radius. This latter convexly shaped configuration is the preferred configuration for bottom portion B and is illustrated in FIGS. 1–3. Likewise, the term "concave configuration" refers to any curved or rounded shape projecting inwardly toward longitudinal axis 2. Examples of such shapes include a hemisphere, an ellipsoid, a hyperbola, a parabola, an arcuate shaped configuration, or an arcuate shaped configuration having multiple arcuate sections such as a combination of a spherical segment having one radius and a spherical end having a second different radius. As noted above, a hyperboloid is the preferred concave configuration for central portion C and is illustrated best in FIGS. 1 and 2. The convexly shaped bottom portion B in combination with the inwardly concave configuration of central portion C functions to enable bottle 1 to contain the pressure of an aerosol therein without any substantial deformation. It should be noted from FIG. 2 that central portion C and bottom portion B have smooth surfaces without any abrupt changes which limits stress concentration points and provides maximum resistance to distortion from internal pressures generated by the aerosol within bottle 1. Although smooth, curved surfaces that merely join without any abrupt changes in curve are within the scope of the invention, preferably all adjoining curves, especially in the bottom portion B, central portion C, and the area of transition from the central portion C to the top portion T, are tangent to each other, substantially eliminating stress concentration points. Furthermore, any distortion which may occur will be substantially uniform and radially symmetrical, and therefore will not be readily apparent from casual viewing of the bottle 1.

Bottom portion B includes a base portion 6 in the shape of a spherical end defined by a convexly shaped surface having radius R1, and a side portion 7 in the shape of a spherical segment and having an outwardly convexly shaped surface defined by the radius R2. The transition between base portion 6 and side portion 7 is defined by a plane extending perpendicular to axis 2 and is represented by line 31. As shown best in FIG. 2, the radius of curvature R1 has a focal point 8 which is located on longitudinal axis 2. As also shown in FIG. 2, the radius of curvature R2 has its focal point 9 located in the plane perpendicular to longitudinal axis 2 defined by line 28. Preferably, radius R1 is about 3.75 cm whereas radius R2 is about 1.9 cm, resulting in a ratio of about 2 to 1. However, the ratio of R1 to R2 may vary from about 1 to 1 to about 5 to 1 with the preferred ratio being 2 to 1. Preferably, R2 is no less than 0.75 of the radius of any bottle.

FIG. 2 also illustrates that the hyperboloid defining central portion C has a radius of curvature defined by R3. The focal point 10 of R3 is located at a point external to bottle 1 in a plane perpendicular to longitudinal axis 2 located midway between and parallel to the planes defined by lines 28 and 29. As the length of R3 increases, the side wall of central portion C becomes more cylindrical-like, and the more the outer wall of central portion C become cylindrical-like, the less resistance to internal pressure it provides. The preferred radius R3 is about 25.4 cm for a bottle of an approximate radius of 2.54 cm. A central portion C having any concentric and concave shape provides a pressure-containing advantage when combined with bottom portion B and top portion T, joined in the manner disclosed. However, the preferred ratio of R3 to the radius of the bottle is approximately 10 to 1.

The top portion T of bottle 1 is integral with the central portion C and has an outwardly projecting convex configuration extending along its longitudinal direction, and defines a cylindrical neck 11 having a tubular opening 12 for receiving and dispensing the aerosol composition. A closure 13 covers the opening 12 and is sealingly attached to neck 11 to contain the aerosol within the body of plastic bottle 1. Closure 13 includes a valve member 14 having an axially extending valve stem 15 which must be either depressed or tilted to release the aerosol composition contained within bottle 1. Valve member 14 and valve stem 15 are conventional components typically utilized in aerosol containers, and need not be further described herein as they are well known in the art. In order to affix closure 13 onto bottle 1, neck 11 includes an outwardly extending annular rim 16 adjacent opening 12, and closure 13 includes a depending flange 17 which is inwardly crimped about rim 16 to retain closure 13 on neck 11 of bottle 1.

As shown best in FIGS. 1 and 2, top portion T has a circular cross-sectional configuration taken through a plane perpendicular to longitudinal axis 2 and has an outwardly convex configuration extending along its longitudinal direction from a point where it merges with central portion C, i.e. line 29 to a point where neck 11 is formed. Midway between its length, i.e. between central portion C and neck 11, top portion T has a flat section 18 having a constant circular cross-section extending along its longitudinal direction to define a cylindrical configuration. Flat section 18 provides line contact (rather than point contact) between adjacent bottles as they are moved side-by-side down a conveyor belt in contact with each other. Bottles with touching curved surfaces, i.e. point contact, tend to slide up or down thus changing the spacing between bottles. In contrast, bottles having straight surfaces such as that provided by flat section 18 where they touch, i.e. line contact, tend not to slide vertically but instead maintain a desired spacing during manufacture and filling.

Top portion T of bottle 1 also includes an annular flange 19 which projects radially outwardly from neck 11 with respect to longitudinal axis 2. Flange 19 has a thickness sufficient to provide the strength and stability necessary to be an attachment point for the cap member 21, described below. Preferably flange 19 is about four times the minimum thickness of outer wall 3 and terminates at an outer edge 20, which is located at a point between a vertical plane parallel to axis 2 and defined by the outer surface of neck 11 and a vertical plane parallel to axis 2 and defined by the outer surface of wall 3 of top portion T. The outer edge 20 of flange 19 is used as one component in a releasable snap fit mounting arrangement for releasably mounting a cap member 21 to the top portion T of bottle 1, as will hereinafter be described.

As best seen in FIG. 2, cap member 21 has a top circular planar support surface 22 and a depending skirt 23 which is used to cover and surround neck 11 and closure 13. An actuator including a push button 24 hingedly mounted on skirt 23 is operatively associated with valve stem 15 to activate the valve member 14 and dispense aerosol composition in a conventional manner. As noted above, the mounting means for releasably mounting cap member 21 and the integral actuator to the top portion T comprises a releasable snap fit arrangement. The releasable snap fit arrangement comprises the outer edge 20 of annular flange 19 projecting from neck 11 and an annular groove 25 formed in skirt 23 of cap member 21 for receiving the outer edge 20 of flange 19. As shown best in FIG. 2, the annular groove 25 is formed by an inner lip 26 projecting radially inwardly from the inner surface of skirt 23, and a plurality of circumferentially-spaced bosses 27. The bosses 27 are spaced circumferentially from each other and each boss 27 is also spaced longitudinally from inner lip 26 to form groove 25. As shown, each boss 27 includes a tapered or beveled lower surface which permits the cap member 21 to be pushed downwardly until skirt 23 flexes slightly outwardly over outer edge 20 of flange 19. Once outer edge 20 passes over the bosses 27, it abuts against inner lip 26 and the upper surfaces of bosses 27 to be held in place. To remove cap member 21, one merely applies sufficient force to reverse the above snap fit process.

The use of flange 19 as an attachment point for the cap member 21 presents important advantages over attachment of the cap member to other locations on the bottle 1. Flange 19 effectively forms a part of the least flexible portions of the bottle 1. Furthermore, flange 19 is contiguous with the structures that define the neck 11. Consequently, when the bottle 1 is under elevated internal pressure, such as can be experienced when a filled and sealed bottle is warmed in the sun or in a hot shower or bath, and thus experiences some degree of deformation and expansion, the relationship of the bottle to the cap member 21 and of the cap member to a valve member 14 mounted within the neck 11 remains stable and virtually unchanged. If the bottle 1 distorts, it is by an extension of the lower, thinner portions of the bottle. Use of the flange 19 attachment location thus avoids such problems as disengagement of the cap member 21 from the bottle 1 or a bottle distortion-caused failure of the cap member to properly relate to the valve member 14.

As the bottom portion B of plastic bottle 1 is convexly shaped, and the central portion C of plastic bottle 1 is preferably a hyperboloid, planar support surface 22 provides a mechanism whereby plastic bottle 1 may stand upright when stored. In order to accomplish this, top support surface 22 is formed in a plane perpendicular to longitudinal axis 2. Also, top support surface 21 is circular in shape and has a diameter which is greater than the diameter of opening 12 in neck 11, but less than the diameter of-top portion T. Support surface 22 thus provides sufficient amount of surface area to enable bottle 1 to stand upright during storage without easily tipping over.

Other modifications of the plastic bottle 1 of the present invention will become apparent to those skilled in the art from an examination of the above description and drawings. Therefore, other variations of plastic bottle 1 may be made which fall within the scope of the following claims even though such variations were not specifically discussed and/or described above. In particular, various types of cap members and closures may be utilized in combination with bottle 1, whether the valve stem 15 is actuated by being tilted or by being depressed or in other ways. Thus, plastic bottle 1 may be suitable for any aerosol product such as insecticides, insect repellents, hairsprays, air fresheners, cleaning preparations, and shave preparations including foams and gels, and the like.

The invention claimed is:

1. A pressure resistant plastic bottle for containing and dispensing an aerosol composition, comprising:

a hollow elongate body having a longitudinal axis and an outer wall, said outer wall defining a central portion, a top portion and an opposite bottom portion, said central portion having a circular cross-sectional configuration taken through a plane perpendicular to said longitudinal axis and having an inwardly projecting concave configuration extending along its longitudinal direction;

said bottom portion being integral with said central portion and wherein the entire bottom portion defines an outwardly projecting convely shaped configuration extending along a direction transverse to said longitudinal axis;

said top portion being integral with said central portion and having an outwardly projecting convex configuration extending along its longitudinal direction and defining a neck having an opening therein for receiving and dispensing an aerosol composition;

a closure covering said opening and sealingly attached to said neck for containing said aerosol composition within said body, said enclosure includes a valve member that enables dispensing of said aerosol composition;

a cap assembly attached to the top portion of said body for covering said closure and valve member;

said cap assembly includes a cap member having a top support surface and a depending skirt, an actuator integral with said cap member and operably associated with said valve member to activate said valve member and dispense said aerosol composition, and mounting means for releasably mounting said cap member and actuator to the top portion of said body;

wherein the support suface of said cap member is located in a plane perpendicular to the longitudinal axis of said body.

2. The plastic bottle of claim 1 wherein said hollow body defines an upper compartment and a lower compartment within said body, each of said compartments having a maximum diameter, and the maximum diameter of one compartment compared to the maximum diameter of the other compartment ranges between a ratio of from about 2:1 to about 1:1.

3. The plastic bottle of claim 2 wherein the maximum diameter of one compartment is greater than the maximum diameter of the other compartment.

4. The plastic bottle of claim 3 wherein the maximum diameter of said upper compartment is greater than the maximum diameter of said lower compartment.

5. The plastic bottle of claim 2 wherein the maximum diameter of said upper compartment is located in said top portion.

6. The plastic bottle of claim 2 wherein the maximum diameter of said lower compartment is located in said bottom portion.

7. The plastic bottle of claim 1 wherein the convexly shaped configuration of said bottom portion comprises a base portion and a side portion, said base portion having a spherical end configuration defined by a radius $R_1$ having its focal point on said longitudinal axis, and said side portion having a spherical segment configuration defined by a radius $R_2$ having its focal point in a plane perpendicular to said longitudinal axis, and wherein $R_2$ is less than or equal to $R_1$.

8. The plastic bottle of claim 1 wherein said top portion includes a flat section between said central portion and said neck, said flat section having a constant circular cross section extending along its longitudinal direction to define a cylindrical configuration.

9. The plastic bottle of claim 1 wherein said central portion has a hyperboloid configuration.

10. The plastic bottle of claim 1 wherein said outer wall is composed of a transparent plastic material.

11. The plastic bottle of claim 1 wherein said neck portion includes an annular rim adjacent said opening and said closure is affixed to said rim.

12. The plastic bottle of claim 1 wherein said mounting means comprises a releasable snap-fit arrangement.

13. The plastic bottle of claim 12 wherein said releasable snap-fit arrangement comprises an annular flange projecting outwardly from the neck of said body and an annular groove formed in the skirt of said cap member for receiving said annular flange.

14. The plastic bottle of claim 13 wherein said annular groove is formed by an inner lip projecting inwardly from the skirt of said cap member, and a plurality of circumferentially-spaced bosses, each boss also spaced longitudinally from said inner lip.

15. The plastic bottle of claim 14 wherein said support surface is substantially circular in shape.

16. The plastic bottle of claim 15 wherein the opening in said neck has a diameter and the support surface has a diameter, and the diameter of said opening is less than the diameter of said support surface.

17. A pressure resistant plastic bottle for containing and dispensing an aerosol composition, comprising:

a hollow elongate body having a longitudinal axis and an outer wall, said outer wall defining a central portion, a top portion and an opposite bottom portion, said central portion having a circular cross-sectional configuration taken through a plane perpendicular to said longitudinal axis and having an inwardly projecting concave configuration extending along its longitudinal direction;

said bottom portion being integral with said central portion and wherein the entire bottom portion defines an outwardly projecting convexly shaped configuration extending along a direction transverse to said longitudinal axis;

said top portion being integral with said central portion and having an outwardly projecting convex configuration extending along its longitudinal direction and defining a neck having an opening therein for receiving and dispensing an aerosol composition; and a closure covering said opening and sealingly attached to said neck for containing said aerosol composition within said body;

wherein said hollow body defines an upper compartment and a lower compartment within said body, each of said compartments having a maximum diameter, and the maximum diameter of one compartment is greater than the maximum diameter of the other compartment.

18. The plastic bottle of claim 17 wherein the maximum diameter of said upper compartment is greater than the maximum diameter of said lower compartment.

19. The plastic bottle of claim 17 wherein the maximum diameter of said upper compartment is located in said top portion.

20. The plastic bottle of claim 17 wherein the maximum diameter of said lower compartment is located in said bottom portion.

21. The plastic bottle of claim 17 wherein the convexly shaped configuration of said bottom portion comprises a base portion and a side portion, said base portion having a spherical end configuration defined by a radius $R_1$ having its focal point on said longitudinal axis, and said side portion having a spherical segment configuration defined by a radius $R_2$ having its focal point in a plane perpendicular to said longitudinal axis, and wherein $R_2$ is less than or equal to $R_1$.

22. The plastic bottle of claim 17 wherein said top portion includes a flat section between said central portion and said neck, said flat section having a constant circular cross section extending along its longitudinal direction to define a cylindrical configuration.

23. The plastic bottle of claim 17 wherein said central portion has a hyperboloid configuration.

24. The plastic bottle of claim 17 wherein said outer wall is composed of a transparent plastic material.

25. The plastic bottle of claim 17 wherein said neck portion includes an annular rim adjacent said opening and said closure is affixed to said rim.

26. The plastic bottle of claim 25 wherein said mounting means comprises a releasable snap-fit arrangement.

27. The plastic bottle of claim 26 wherein said releasable snap-fit arrangement comprises an annular flange projecting outwardly from the neck of said body and an annular groove formed in the skirt of said cap member for receiving said annular flange.

28. The plastic bottle of claim 27 wherein said annular groove is formed by an inner lip projecting inwardly from the skirt of said cap member, and a plurality of circumferentially-spaced bosses, each boss also spaced longitudinally from said inner lip.

29. The plastic bottle of claim 28 wherein said support surface is substantially circular in shape.

30. The plastic bottle of claim 29 wherein the opening in said neck has a diameter and the support surface has a diameter, and the diameter of said opening is less than the diameter of said support surface.

* * * * *